US006138602A

United States Patent [19]

Cary

[11] Patent Number: 6,138,602

[45] Date of Patent: Oct. 31, 2000

[54] CATAMARAN—V BOAT HULL

[76] Inventor: Elton Mikell Cary, 4000 Toweside Terr., #501, Miami, Fla. 33138

[21] Appl. No.: 09/172,532

[22] Filed: Oct. 14, 1998

[51] Int. Cl.[7] ..... B63B 1/32

[52] U.S. Cl. ..... 114/288; 114/291

[58] Field of Search ..... 114/271, 288–291; D12/310, 312

[56] References Cited

U.S. PATENT DOCUMENTS

| | | | |
|---|---|---|---|
| 1,042,636 | 10/1912 | Apel | 114/290 |
| 1,396,831 | 11/1921 | Gardner | 114/288 |
| 1,835,564 | 8/1931 | Grayson et al. | 114/290 |
| 2,397,683 | 4/1946 | Nelson | 114/288 |
| 3,469,549 | 9/1969 | Rae | 114/288 |
| 3,547,064 | 12/1970 | Glass | 114/66.5 |
| 3,802,370 | 4/1974 | Collier | 114/66.5 |
| 4,022,143 | 5/1977 | Krenzler | 114/271 |
| 4,083,320 | 4/1978 | Yost | 114/271 |
| 4,233,920 | 11/1980 | Wood et al. | 114/56 |
| 4,398,483 | 8/1983 | Wood et al. | 114/56 |
| 4,584,959 | 4/1986 | Allison | 114/288 |
| 4,609,360 | 9/1986 | Whitehead | 440/69 |
| 4,619,215 | 10/1986 | Wood et al. | 114/56 |
| 4,915,668 | 4/1990 | Hardy | 440/69 |
| 5,452,676 | 9/1995 | Fiore | 114/291 |
| 5,456,202 | 10/1995 | Schoell | 114/291 |

*Primary Examiner*—Sherman Basinger
*Attorney, Agent, or Firm*—Michael C. Cesarano

[57] ABSTRACT

A boat hull of exceptional performance and stability combines a deep V entry configuration transitioning to a catamaran-like after section to produce the soft water entry that is characteristic of a deep V design together with the lateral stability that is characteristic of a catamaran.

4 Claims, 6 Drawing Sheets

CATAMARAN— V BOAT HULL

BACKGROUND OF THE INVENTION

Boat hulls for planing watercraft encounter a wide variety of water surface conditions over which the hull must provide safe transport. Typical surface conditions range from flat, smooth surfaces associated with protected bays and inlets to choppy waves found in open bays to smooth or choppy swells encountered in offshore ocean areas. Hulls designed to provide safe and comfortable carriage under one set of sea conditions may be unsafe and uncomfortable when used under conditions different from those for which the hull was primarily designed.

The most popular hull design for power boats traveling on a plane is a V configuration. The V configuration represents a compromise between lateral stability, such as may be achieved with a catamaran or flat bottom design, and the need to avoid excessive bouncing or "pounding" that occurs when a flat or rounded bottom is propelled at planing speeds over a moderately choppy water surface. One weakness of most designs is that, as the speed of the hull increases, a wide forward configuration may tend to act as an airfoil, causing the hull generate excessive lift in the forward portion that sometimes produces the up and down motion commonly known as "porpoising." This phenomenon is exacerbated in rough or choppy water in which the hull may be given an initial upward lift by a wave or swell, may be further lifted by the aerodynamic force of the air and, after reaching a maximum height, will fall back to the surface to crash against the next wave. Such pounding is not only uncomfortable to passengers, but places undue stress upon structural components within the boat and can be dangerous.

Where high speed operation is desired, a deepening and narrowing of the V configuration is helpful in reducing the aerodynamic tendency of the hull to act as an airfoil and become airborne over the water surface. The deep V also helps to part the water, resulting in a lessening of the pounding of the hull as it meets the water. A deep V having a 24° dead rise at the transom permits a softer water entry when landing after leaving the water. These advantages may be increased by sharpening and lightening the forward entry area. These features may be found on nearly all modern ocean running high performance hulls.

Further deepening of the V will ameliorate the vertical motion of the forward part of the hull, providing greater longitudinal stability while continuing to reduce porpoising action. However, such benefits are gained at the expense of lateral stability, and the natural tendency of a deep V hull to rock and roll in moderate seas at slow speeds or while drifting places a practical limit upon the angle of the V that a hull may have without sacrificing comfort or safety.

In sharp contrast to deep V configurations are catamaran and flat bottom hull designs. Such designs may incorporate a right-angle hard chine at or near the water surface, and are exceptionally stable against lateral rolling. However, because they lack the features of a V or deep V configuration, they are not well suited for high speed rough water travel.

OBJECTS OF THE INVENTION

The present invention combines the forward hull configuration of a deep V hull with the aft hull configuration of a catamaran to secure the benefits of both.

It is an object of this invention to provide a hull that exhibits the beneficial high speed and rough water characteristics of a deep V hull while also enjoying the lateral stability of a catamaran.

It is a further object of this invention to combine in one hull a light and sharp forward entry area with a wide and stable aft portion to gain running efficiency through a "surface effect" lift.

It is a further object of this invention to provide safety and comfort for persons within the hull during periods of drifting or slow speed operation in moderate seas.

It is a further object of this invention to provide a hull that is stable at all speeds in all but the most heavy seas.

It is a further object of this invention to provide a hull that will receive a propeller shaft at a point partway along the hull and will allow efficient operation of a propeller and a clear path for propwash extending the remainder of the length of the hull.

It is yet another object of this invention to provide a hull to which one or more motors may be attached whereby the propellers from said motors will operate efficiently upon hard water at or near the transom of the hull.

SUMMARY OF THE INVENTION

A boat hull of exceptional performance and stability combines a deep V entry configuration transitioning to a catamaran-like after section to produce the soft water entry that is characteristic of a deep V design together with the lateral stability that is characteristic of a catamaran.

DETAILED DESCRIPTION OF THE PREFERRED EMBODIMENTS

Figure 1:
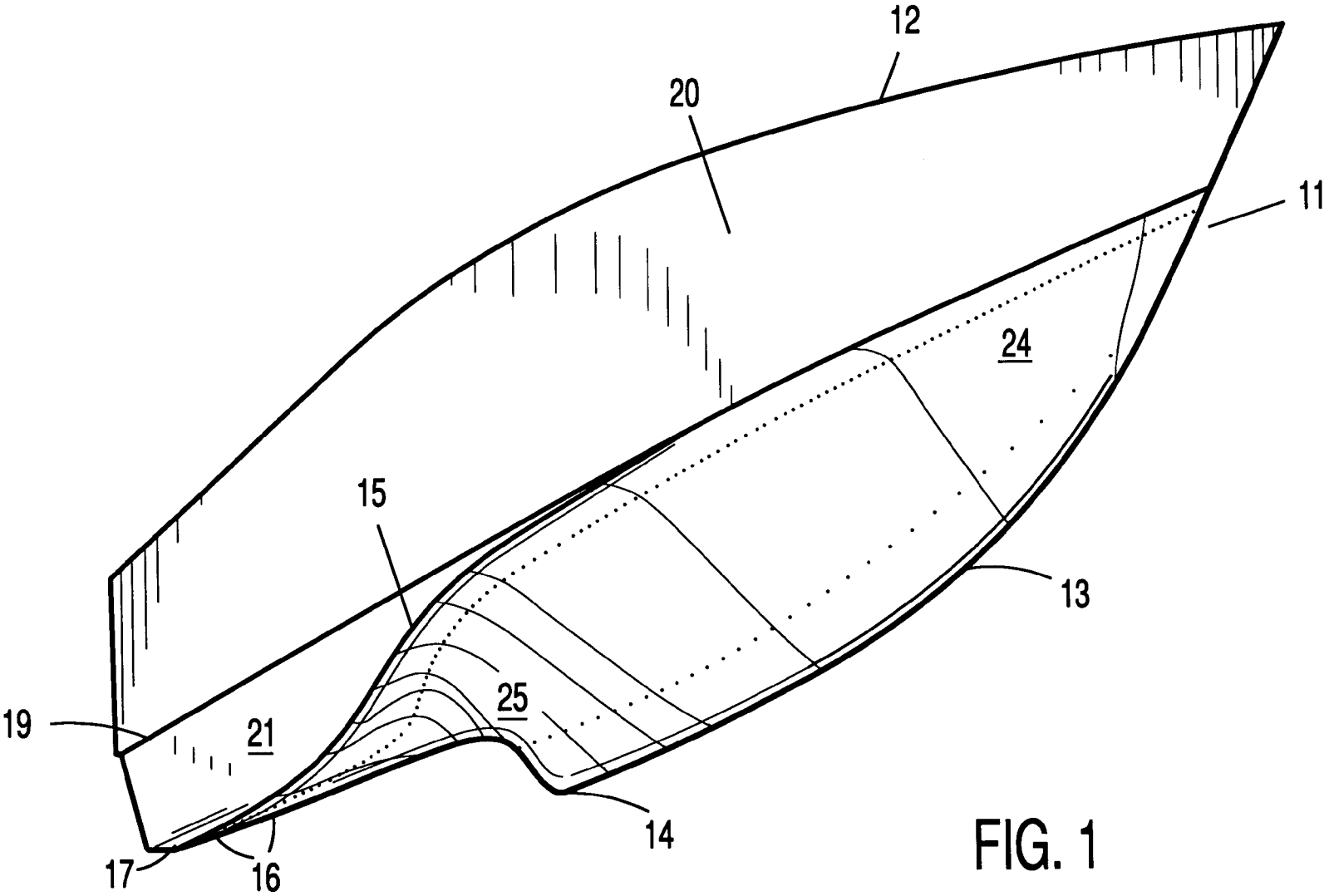
FIG. 1 shows a perspective view of the hull of this invention from the lower forward starboard quadrant.

Referring to FIG. 1, a hull is shown in which the bow 11 has a deep V configuration. A centerline 13 along the hull is smoothly curved from the bow 11 to a point 14 that is more than half the distance of the hull length from the bow. To either side of the centerline 13 the forward portion of the hull 24 is symmetrical about the centerline to form a deep V configuration between centerline 13 and chine 19.

Chine 19 is formed along the hull on either side to form a freeboard area 20 above chine 19 and below gunwhale 12. Lower chine 15 breaks away from chine 19 and extends downwardly to form sponsons 16. The downward extension of chine 15 causes the outermost portions of the lower hull 25 to transition from a deep V to a gull wing configuration forward of point 14. A vertical running area 21 is formed by the outermost surface of sponson 16 below chine 19. The lowest surface of the sponson forms a running area 17 that may be horizontally planar at the bottom, or may form a V or a curved V surface. The running area 17 is preferably longitudinally formed as a V with the forward end being at the apex of an acute angle, although it may also take on other configurations such as being equally rounded at the leading and trailing ends.

Centerline 13 is smoothly curved from the bow to a point 14, located more than half the distance of the hull length from the bow. At point 14, the hull angles sharply upward to form a laterally disposed angled surface 23 through which a propeller shaft may be received. Aft of point 14 centerline 13 bisects angled surface 23 and thereafter forms the apex of an inverted V that extends to the rear of the bottom of the hull.

Figure 2:
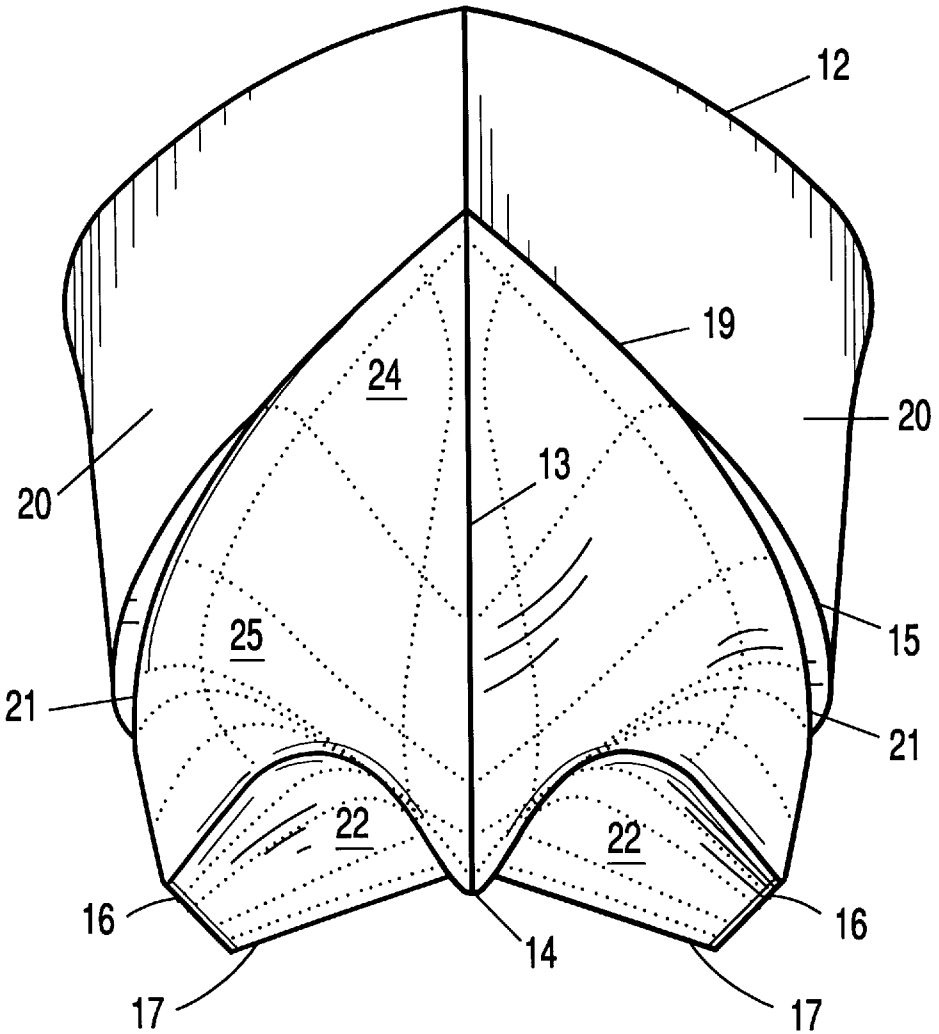
FIG. 2 shows a perspective view of the hull from below and forward of the hull.

In FIG. 2, the hull configuration at point 14 is shown to be symmetrical about centerline 13. Sponsons 16 are formed by the lower hull surfaces 22 and vertical running areas 21. Lower hull surfaces 22 meet at the centerline aft of point 14 to form an inverted V.

Figure 3:
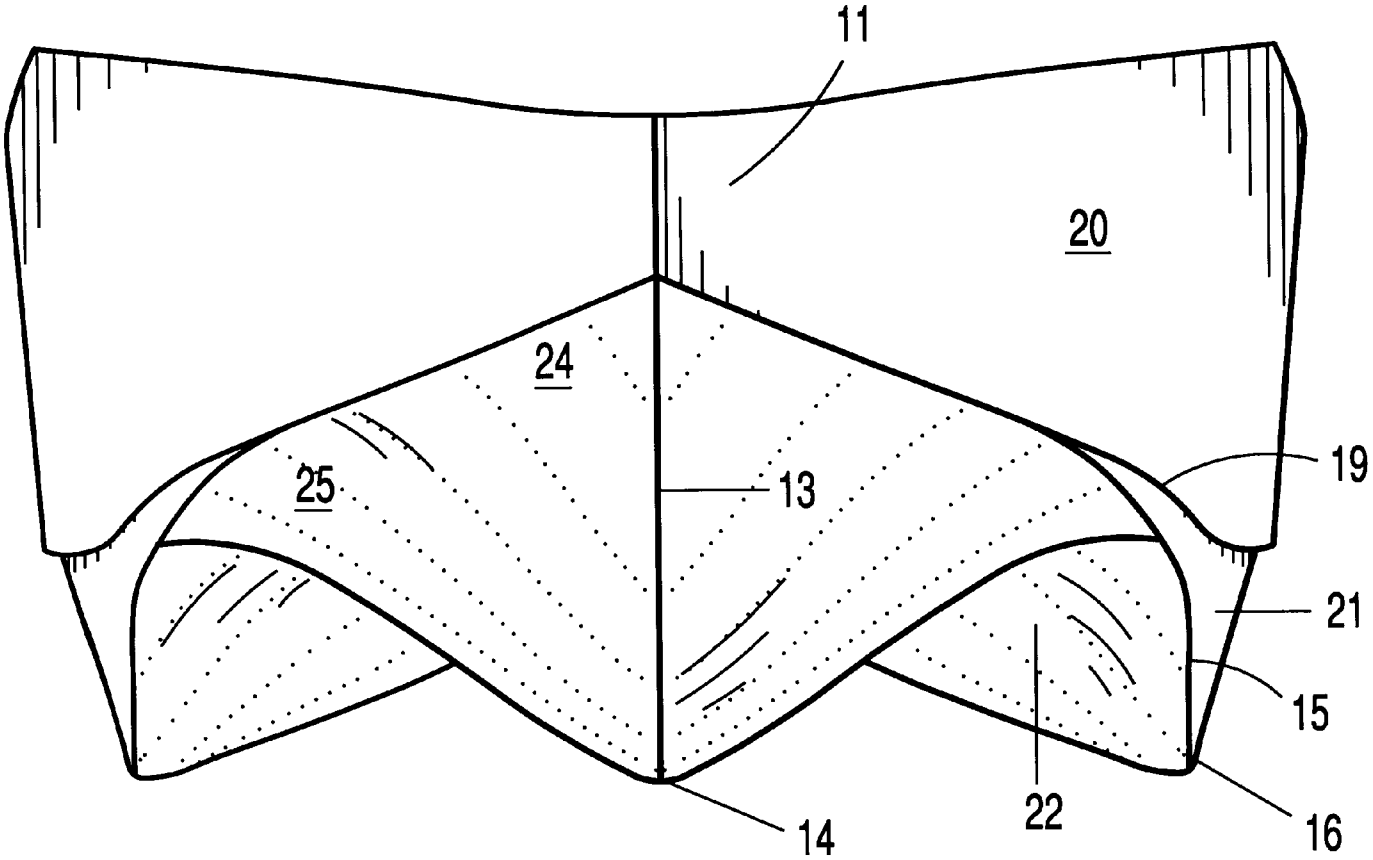
FIG. 3 shows a front elevation view of the hull.

FIG. 3 shows a front elevation view of the deep V configuration of the bow and forward entry area. Centerline 13 extends from the bow 11 in a smooth curve until it reaches point 14. Sponsons 16 are approximately the same depth as the centerline at point 14, although the precise depth of sponsons 16 relative to point 14 may vary depending upon other design considerations. Such other design considerations may include, for example, the placement of a propeller and propeller shaft within the hull, outboard motor attachment, maximum design speed, longitudinal weight distribution, and other variable parameters. At the point where chine 15 breaks away from chine 19, the lower hull begins a transition from a deep V to a gull wing configuration. Chine 19 separates freeboard area 20 from vertical running area 21, and may be configured to serve the auxiliary function of downwardly dispersing the spray that is developed when the hull is on a plane.

Figure 4:
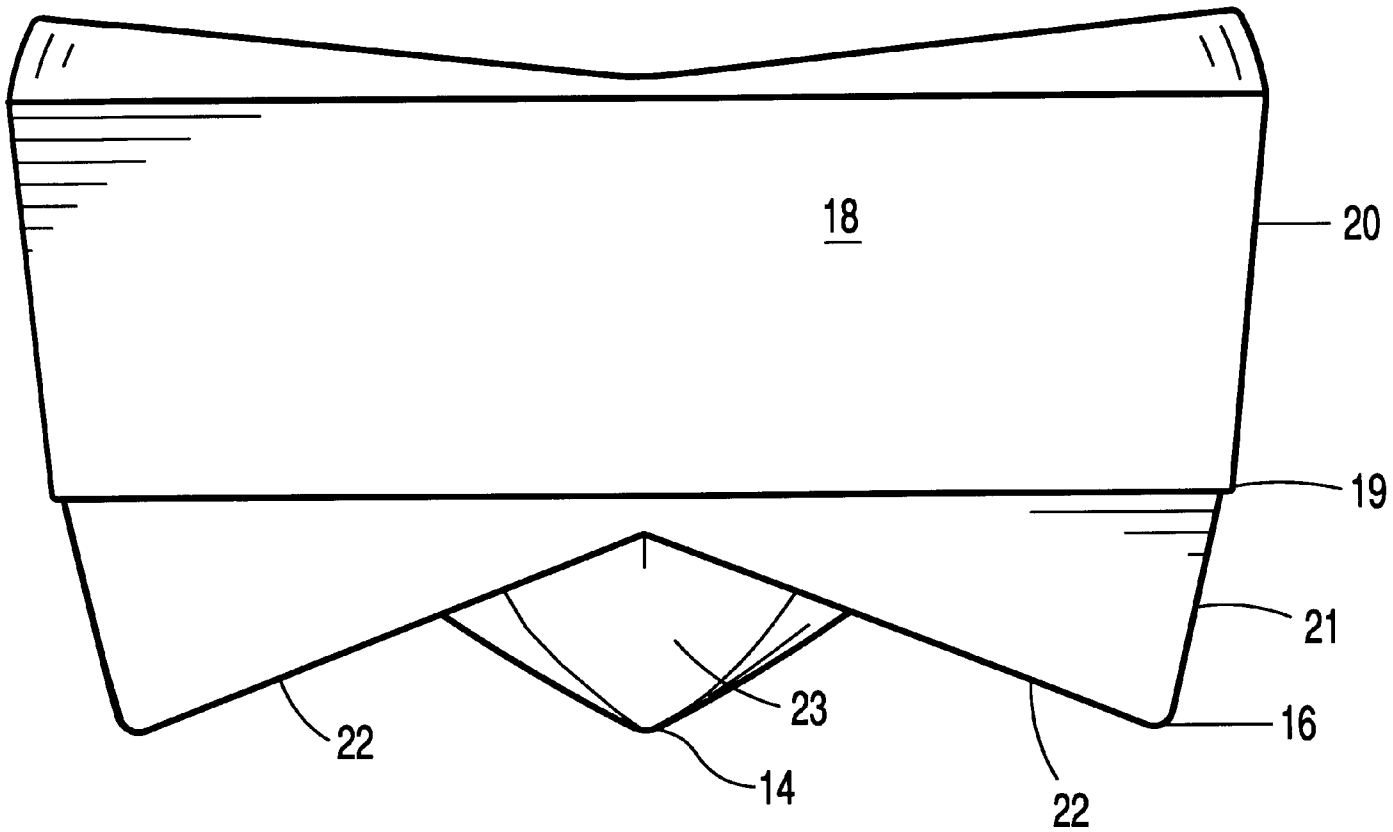
FIG. 4 shows a rear elevation view of the hull.

FIG. 4 shows the hull design from the rear. An inverted V configuration is formed by inner sponson surfaces 22 and the interior space formed by those surfaces extends without obstruction from angled surface 23 to the aft end of the hull. For operation with outboard motors, transom 18 may be used to attach and secure one or more outboard motors or outboard motor holders. Angled surface 23 is formed immediately aft of point 14, and is smoothly molded into surfaces 22. The sharpness of the angle formed by angled surface 23 may be varied depending upon whether the hull is designed for an inboard motor, propeller shaft and propeller, or for an outboard or outdrive configuration. Although not necessarily precisely vertical, vertical running surfaces 21 are located to form sponsons 16 very near the outermost lateral portions of the hull. As so located, sponsons 16 will provide a maximum of lateral stability against roll.

As is shown in FIGS. 3 and 4, the deep V forward hull portion and the sponsons 16 form three primary points of contact with the water when the hull is on a plane. As so configured, air may be inducted under the hull inboard and below chine 15, and may cause the aft portion of the hull to be lifted slightly, thereby creating a "surface effect" that improves running efficiency and reduces drag.

Figure 5:
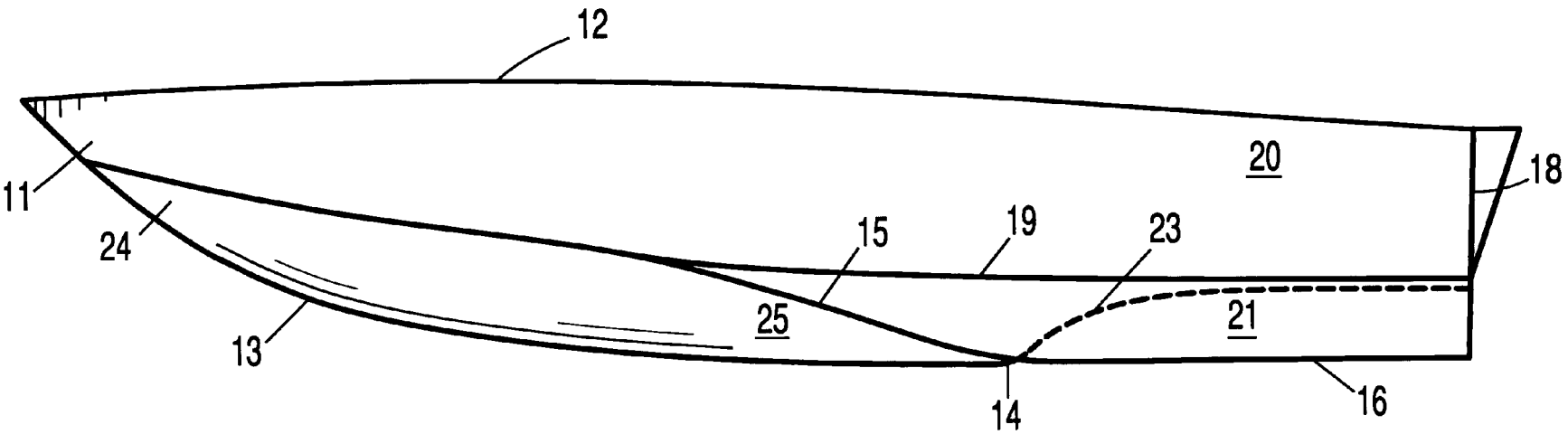
FIG. 5 shows a left side view of the hull.

FIG. 5 shows a side view of the hull in which the centerline 13 is smoothly curved from the bow 11 back to point 14 and then is angled upwardly to form curved surface 23. The sharpness of the upward angle at point 14 is dependent upon other design factors, and may be smoothly rounded for configurations in which a propeller shaft and propeller will not be received in that area. Sponsons 16 are formed by chine 15 smoothly extending downwardly from chine 19, and reach approximately the same depth as the centerline at point 14. Thereafter, sponsons 16 extend longitudinally to the rear of the hull. In FIG. 5, transom 18 is shown as extending slightly aft of the rearmost portion of the hull.

Figure 6:
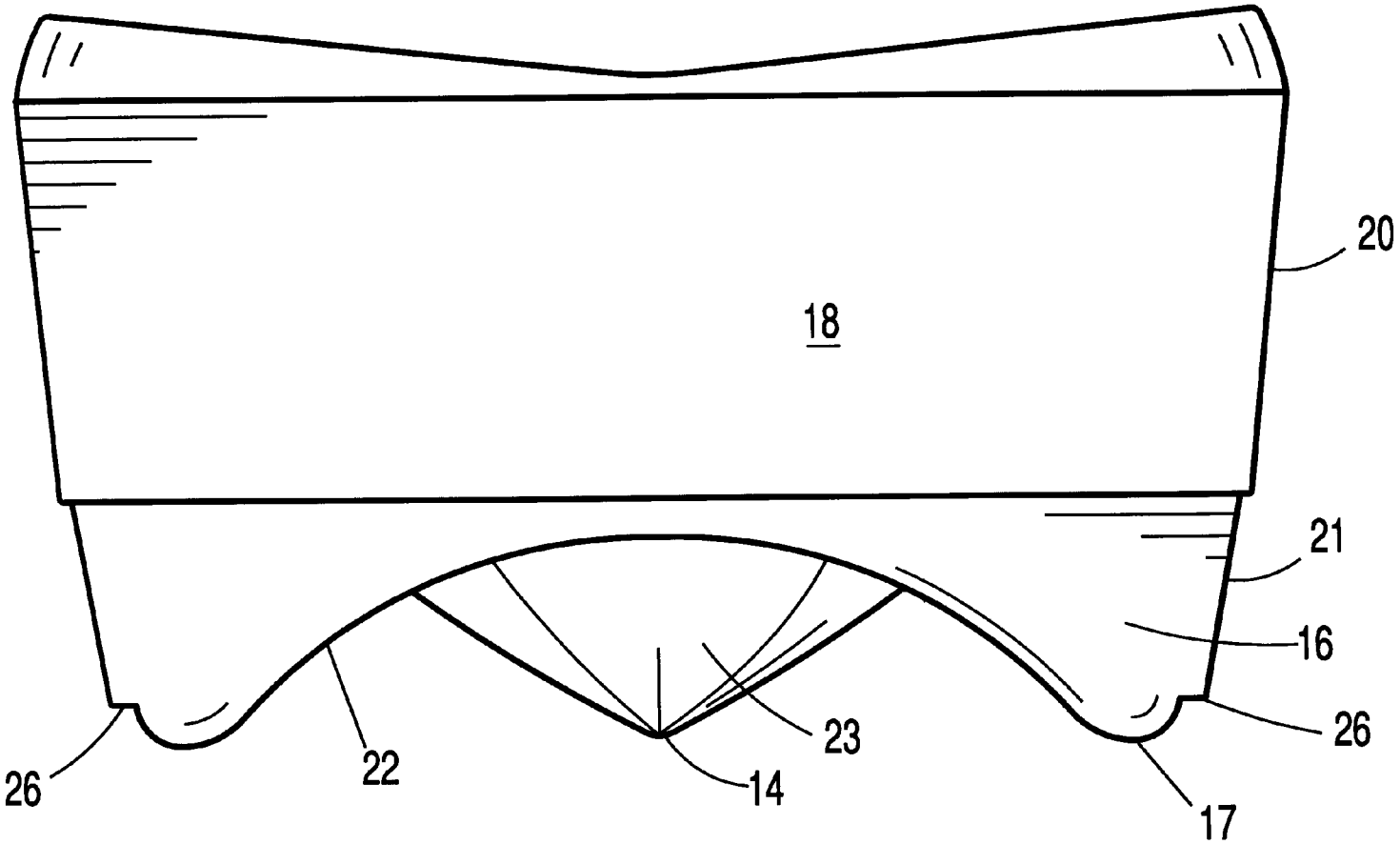
FIG. 6 shows another embodiment of the invention in a rear elevation view.

FIG. 6 shows another embodiment in which the sponsons 16 are curved at their lower surfaces 17 to form rounded running surfaces. Inner sponson surfaces 22 are rounded to form concave surfaces between the centerline 13 and the lowermost portion of the sponsons. The outboard portion of each sponson has a hard, nearly right angle chine 26 where the bottom surface 17 meets vertical running surface 21. As so configured, inner sponson surfaces 22 form a more or less continuously concave curve rather than an inverted V. In this embodiment the inner sponson surfaces 22 form an unobstructed passageway from angled surface 23 to the rearmost portion of the lower hull. It is to be understood that the illustrations shown above are for exemplary purposes only and various changes may be made to my design by those of skill and art without departing from the spirit and scope of my invention.

The claims appended hereto are meant to cover modifications and changes within the spirit and scope of the present invention.

What is claimed is:

1. A hull for a power boat comprising:

a forward section, a midsection, and an aftersection;

said forward section including a bow having a deep V configuration symmetrically disposed about a centerline, said forward section extending rearwardly at least one-half the length of said hull, the rearmost lower portion of said forward section forming a running surface that is in contact with water when said hull is on a plane;

said midsection comprising a transition area in which two sponsons are formed symmetrically in distal portions of said hull, said sponsons having smoothly tapered forward ends transitioning from downwardly curved chines located on the surface of said midsection, said sponsons extending longitudinally rearwardly toward the rear of said hull;

the forward lower portion of said midsection being a continuation of said running surface symmetrically disposed about said centerline, forming a gradually widening V in a rearward direction, and extending rearwardly to a lowermost point at which said lower portion of said midsection transitions sharply upwardly to form a rear and downwardly facing surface curved to extend toward the stern, the rearmost portion of said downwardly facing surface transitioning to a downwardly and inwardly facing configuration symmetrically disposed about said centerline and formed by the interior surfaces of said sponsons and a central portion of said hull located between said sponsons;

a lower portion of said aftersection having a downwardly and inwardly facing configuration symmetrically disposed about said centerline, said sponsons being located longitudinally along said distal portions of said aftersection and extending into the water to approximately the same depth as said lowermost point of said midsection, each sponson forming a running surface that is in contact with the water when said hull is on a plane;

said lower portion of said aftersection terminating at a transom and forming an inwardly and downwardly facing surface symmetrically disposed about said centerline immediately adjacent said transom.

2. A hull as recited in claim 1, in which said aftersection terminates at the rearmost portion of said running surface of said hull.

3. A hull as recited in claim 1, in which said downwardly and inwardly facing surfaces of said sponsons on said midsection and said aftersection and said lower portion of said midsection and said aftersection form a substantially concave configuration and are joined smoothly with rounded edges.

4. A hull as recited in claim 1, in which said each sponson has a chine formed longitudinally on the outermost surface of said sponson.

* * * * *